US007500292B2

(12) United States Patent
Miller et al.

(10) Patent No.: US 7,500,292 B2
(45) Date of Patent: Mar. 10, 2009

(54) HYDRODYNAMIC TREATMENT OF TUBULAR KNITTED FABRICS

(75) Inventors: Robert A. Miller, New Ringgold, PA (US); Asli Begenir, Winston-Salem, NC (US); Michael D. Abbott, Statesville, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 144 days.

(21) Appl. No.: 11/510,968

(22) Filed: Aug. 28, 2006

(65) Prior Publication Data

US 2008/0060180 A1 Mar. 13, 2008

(51) Int. Cl.
*D04H 3/10* (2006.01)
*D04B 39/00* (2006.01)

(52) U.S. Cl. ..... 28/104; 28/167; 28/142

(58) Field of Classification Search ..... 28/167, 28/104, 105, 103, 142, 154, 162, 163, 169; 8/151, 147, 149.1, 149.2, 149.3, 151.1; 68/205 R, 68/200, 201, 5 D; 26/80, 81, 83–85; 66/147, 66/148, 170, 171; 34/438, 440, 464, 459, 34/461

See application file for complete search history.

(56) References Cited

U.S. PATENT DOCUMENTS 2,714,756 A * 8/1955 Redman ..... 26/18.5
3,120,051 A * 2/1964 Spurgeon ..... 28/167
3,195,212 A * 7/1965 Wehrmann ..... 26/18.6
3,293,724 A * 12/1966 Kimball ..... 28/143
3,333,314 A * 8/1967 Harris ..... 28/154
3,688,354 A * 9/1972 Cohn et al. ..... 26/52
3,922,752 A * 12/1975 Holm ..... 34/120
4,454,171 A * 6/1984 Diggle et al. ..... 8/149.1
4,523,389 A * 6/1985 Diggle et al. ..... 34/105
4,967,456 A 11/1990 Sternlieb et al.
4,995,151 A 2/1991 Siegel et al.
5,136,761 A 8/1992 Sternlieb et al.
5,546,622 A * 8/1996 McAlister et al. ..... 68/205 R
5,588,170 A 12/1996 Strahm
5,632,072 A 5/1997 Simon et al.
5,657,520 A 8/1997 Greenway et al.
5,737,813 A 4/1998 Sternlieb et al.
5,806,155 A 9/1998 Malaney et al.

(Continued)

FOREIGN PATENT DOCUMENTS

EP 0337451 10/1989

OTHER PUBLICATIONS

PCT International Search Report, Dec. 14, 2007, pp. 1-3, European Patent Office, Netherlands.

*Primary Examiner*—Amy B Vanatta
(74) *Attorney, Agent, or Firm*—Womble Carlyle Sandridge & Rice PLLC

(57) ABSTRACT

A method is provided for conditioning a tubular knitted fabric. The method includes the step of placing on a supported member a tubular knitted fabric formed of yarns, the yarns having fibers of a high cotton content. The layers of the fabric are arranged in overlying layered relation, each layer having an outer surface. The fabric is traversed at a preselected rate while subjecting the outer surfaces of the overlying layers to jets of fluid at pressures of about 40 bar absolute or lower. The fibers forming the overlying layers do not interlock the overlying layers and are separable by subsequent fabric finishing or laundering.

8 Claims, 4 Drawing Sheets

U.S. PATENT DOCUMENTS 5,862,575 A 1/1999 Zolin
5,870,807 A 2/1999 Beaty et al.
5,933,931 A 8/1999 Greenway
5,983,469 A 11/1999 Beaty et al.
6,343,410 B2 2/2002 Greenway et al.
6,442,809 B1 9/2002 Greenway et al.
6,442,810 B2 9/2002 Greenway et al.
6,557,223 B2 5/2003 Greenway et al.
6,735,834 B2 5/2004 Fleissner

* cited by examiner

| | HYDRODYNAMICALLY TREATED | | | | | | BLEACHED/DYED & DRIED | | | | |
|---|---|---|---|---|---|---|---|---|---|---|---|
| Fabric | Before | 40 Bar 120 m/min | 35 Bar 100 m/min | 30 Bar 30 m/min | 30 Bar 30 m/min | 25 Bar 30 m/min | 40 Bar 120 m/min | 35 Bar 100 m/min | 30 Bar 30 m/min | 30 Bar 30 m/min | 25 Bar 30 m/min |
| Width (in) | 23.625 | 21 | 21.75 | 21.5 | 20.9 | 21.75 | 21.5 | 22 | 22 | 21.75 | 21.75 |
| Weight (oz/sqyd) | 2.15 | 4.23 | 4.35 | 4.23 | 4.51 | 4.25 | 4.06 | 4.24 | 4.3 | 4.44 | 4.25 |
| Burst Strength | 77.5 | 80 | 79.3 | 78 | 76.7 | 79 | 55 | 71 | 68 | 64 | 66 |
| Shrinkage (%) | | | | | | | | | | | |
| 1 Wash | | | | | | | | | | | |
| Length | 13 | 11.5 | 9.3 | 12.2 | 8.1 | 7.7 | 4.8 | 3.5 | 4.3 | 6 | 3.5 |
| Width | 13 | 2.2 | 3 | 3.8 | 3 | 4 | 6.5 | 6.8 | 2.8 | 3.5 | 5.8 |
| 3 Washes | | | | | | | | | | | |
| Length | 14.5 | 13.2 | 9.8 | 12.8 | 9.6 | 9.3 | 6 | 3.5 | 4.5 | 6 | 3.8 |
| Width | 14.2 | 3.2 | 5 | 4.2 | 1 | 6.3 | 6.8 | 8.2 | 2.9 | 3.7 | 5.9 |
| 5 Washes | | | | | | | | | | | |
| Length | 15.2 | 14 | 10.5 | 15.3 | 9.1 | 10.8 | 6.5 | 3.5 | 4.8 | 6.2 | 4.7 |
| Width | 12.3 | 3.6 | 6.3 | 4.5 | 2.3 | 7 | 6 | 8.2 | 4.2 | 3.8 | 5.9 |
| Pilling | | | | | | | | | | | |
| 1st Cycle | 4 | 4/4 | 4/4 | 4/4 | 4/4 | 4/4 | 4/4 | 4/4 | 4/4 | 4/4 | 4/4 |
| 2d Cycle | 3 | 3/3 | 3/3 | 3/3 | 3/3 | 3/3 | 4/4 | 4/4 | 4/4 | 4/4 | 4/4 |

FIG. 4

HYDRODYNAMIC TREATMENT OF TUBULAR KNITTED FABRICS

FIELD OF THE INVENTION

The present invention relates generally to hydrodynamic conditioning of textile fabrics, and, more particularly, to a method for hydrodynamically treating the multiple layers of tubular knitted fabrics.

BRIEF DESCRIPTION OF THE DRAWINGS

FIG. 4 is a table of exemplary test data for the hydrodynamic conditioning and finishing process of the present invention.

DETAILED DESCRIPTION OF THE PREFERRED EMBODIMENTS

Figure 1:
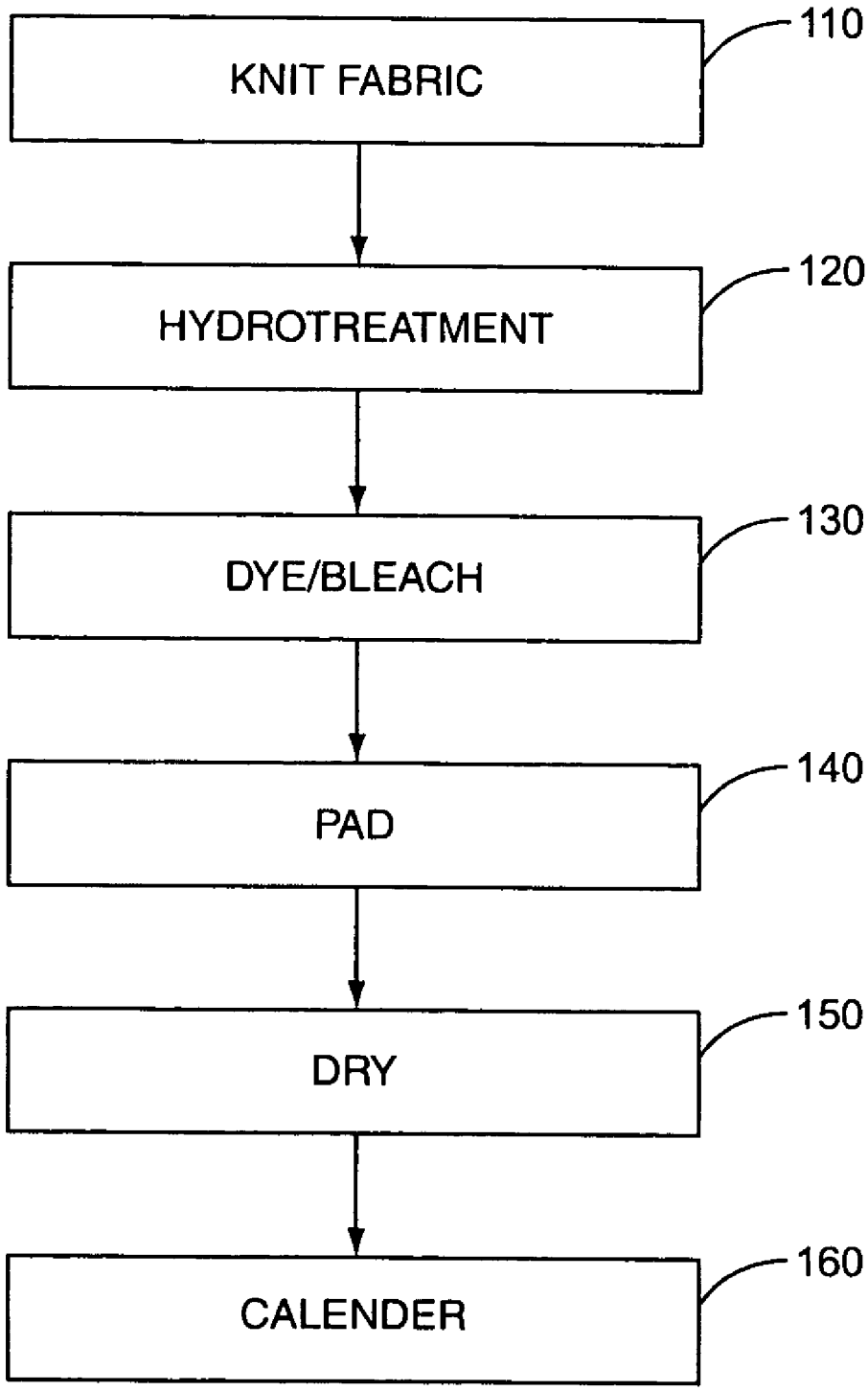
FIG. 1 is a flow diagram of the hydrodynamic conditioning and finishing process of the present invention.

Certain exemplary embodiments of the present invention are described below and illustrated in the attached Figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications and improvements are within the scope of the present invention.

Definitions:

"Bursting Strength" refers to the force required in pounds to rupture a fabric when performed in accordance with a standard test method for the particular fabric construction.

"Dimensional Stability" refers to the ability of a textile material to maintain, or return to, its original geometric configuration.

"High Cotton Content" refers to fabric having a cotton content, by weight, of greater than about 50 percent.

"Hydroenhancement" refers to a process whereby woven or knitted fabrics are subjected to dynamic fluid jets to achieve certain physical properties.

"Hydroentanglement" refers to the process for forming a fabric by mechanically wrapping wrapping and knotting fibers in a web, typically non-woven, through the use of high velocity, high pressure jets or columns of water.

"Pilling" refers to the tendency of fibers in a textile to work loose from a fabric surface and form balls or matts of fiber that remain attached to the surface of the fabric.

"Residual Shrinkage" refers to the amount of shrinkage in the length and width directions, expressed in percent, which the finished fabric and/or article of apparel may still undergo when subjected to home laundering by the consumer and/or end user.

"Torque" in a tubular knitted fabric refers to the tendency of a fabric to skew or twist as a result of shifting of the courses and wales.

Hydroentanglement and hydroenhancement are generally known in the art. Hydroentanglement conventionally has been used non-woven fabrics where one or more layers or batts of loose fibers have been subjected to fluid jets to intermingle and permanently interlock the fibers into a more composite mass. Hydroenhancement, on the other hand, has typically been employed to create certain surface effects or patterns on the surfaces of single-ply fabrics.

The present invention is directed to a method for hydrodynamically treating tubular, or other multi-ply knitted fabric. More specifically, the method produces a tubular knitted fabric that is conditioned by hydrodynamic treatment without permanently entangling or permanently interlocking the knitted fabric layers together, while creating a knitted fabric having a low level of residual shrinkage. As defined above, residual shrinkage refers to the amount of shrinkage which a fabric or apparel will still undergo after being subjected to repeated home launderings. The lower the level of residual shrinkage, the more desirable is the finished fabric, or apparel formed therefrom. Additionally, the pressure of the jet nozzles does not skew or spiral the fabric. Further, the surface of the fabric is aesthetically pleasing, having a level and relatively smooth surface and a soft hand.

Turning now to FIG. 1, the one embodiment of the process of the present invention is illustrated in a flow diagram. The process begins with the formation of a tubular knitted fabric (Step 110). In the embodiments described herein, the tubular knitted fabrics have a high cotton content. In one embodiment, the tubular knitted fabric comprises 100 percent open end spun cotton that is circular knitted; however, the present invention is not limited to yarns formed by any particular method. As is known in the art, circular knitting involves the production of fabric on a circular knitting machine to form a tube, with the yarns forming the tube running continuously around the fabric. The initially knitted, but untreated tubular knitted fabric is referred to as "greige," or unbleached fabric.

Figure 2:
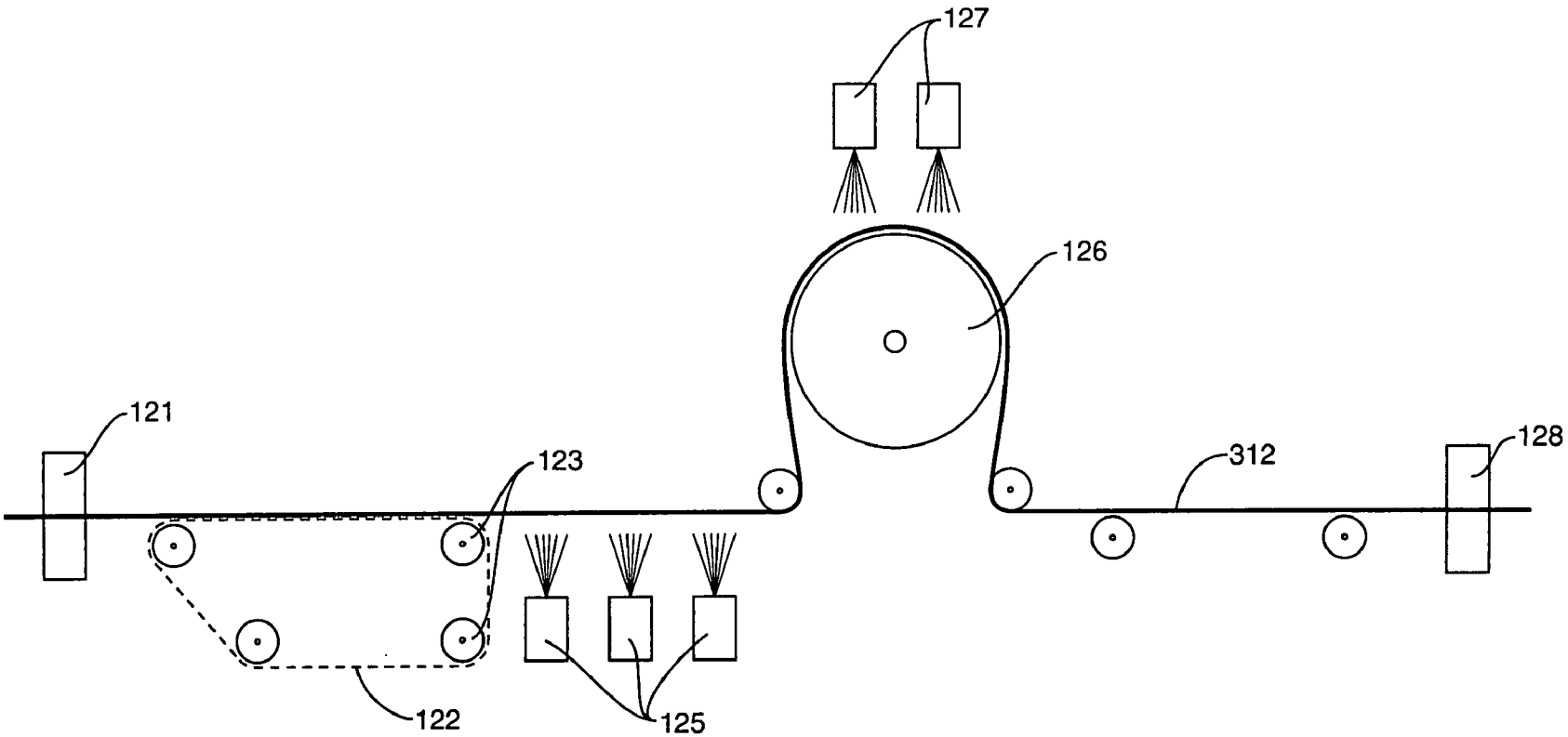
FIG. 2 is a schematic view of the hydrodynamic conditioning process of the current invention.

Following formation of the tubular knitted fabric, rolls of the greige fabric are readied for hydrodynamic treatment. Referring also to FIG. 2, the hydrodynamic treatment (Step 120) of the present process is shown in detail. Hydrodynamic treatment, or hydrotreatment, uses a mechanical action via fine, high-velocity fluid jets that are directed against the flat surfaces of a fabric. Conventionally, however, where multiple layers or loosely formed batts are involved, this treatment has the effect of permanently entangling the layers or batts into a single composite structure. FIG. 2 is exemplary of one commercially available entangling machine. In particular, the machine employed in the current process is a Fleeissner, two-stage belt and drum entangler having five jet manifolds. While a Fleeissner entangler has been described herein, those skilled in the art will appreciate that other entanglers with similar operating capabilities may also be used to accomplish the method described herein. The machine may comprise a straightener/feeder 121 which typically aligns and feeds fabric to the downstream fluid treatment. The inventors were able to use the same straightener/feeder 121 to feed a tubular knitted fabric. A support member, or conveyor belt 122, is provided to traverse the tubular fabric via a series of spaced rollers 123 beneath the first series of three jet manifolds 125. The belt 122 used in the present process is a 103 Mesh PET type belt available from Albany International of Albany, N.Y. A jet strip available from Gozz Beckert of Germany is used in conjunction with the belt. The parallel spaced manifolds 125 each comprise high velocity jet nozzles (not shown), usually arranged in multiple rows, wherein the jets are each between about 0.005 and 0.007 inches in diameter and arranged at a density of between about 30 and 60 jets per square inch. The downstream manifolds 127 are similarly configured.

The manifolds 125, 127 on the Fleeissner entangler are variably controllable for hydrodynamic jet pressures of between about 25 bar and 250 bar; however, the entangler is typically operated at the higher end of the pressure range for at least two reasons: (1) entanglers are conventionally designed for forming non-woven constructions of interlocked loose fibers, and (2) higher pressures conventionally are believed necessary to obtain maximum entanglement and optimal surface effects. The machine and belt 122 can operate at feed-through rates of up to about 350 meters per minute. As will be discussed in greater detail below, a range of speed and pressure combinations have been found to provide acceptable results in the method described and claimed herein.

After passing beneath the first series of jet manifolds 125, the fabric advances around a cylindrical drum 126 wherein the opposite, or bottom, side of the tubular knitted fabric is subjected to similar hydrodynamic treatment. The drum 126 also comprises spaced fluid-permeable openings (not shown) that are configured like a mesh screen. While the number and arrangement of manifolds 127 may vary, the Fleeissner two-stage entangler comprises a series of two jet manifolds 127.

Upon exiting the second series of jet manifolds 127, the hydrodynamically treated fabric is next fed through a conventional dryer where excess moisture in the fabric is substantially removed. As will be described in greater detail below, the hydrodynamically treated fabric has physical properties that are substantially different from the griege fabric. For example, the hydrodynamic treatment has the effect of increasing the dyeable surface areas of the yarns such that dye uptake coverage is increased. Also, it is anticipated that the required dwell, or cycle, time in a conventional dye bath or bleach bath will be reduced since the fabric will have been pre-cleaned by the hydrodynamic treatment. Further, the inventors have unexpectedly found that at manifold pressures at between about 25 bar and 40 bar, the two layers of the tubular knitted fabric are not permanently entangled; rather, the hydrodynamically treated fabric may be subsequently finished, without the need for any manipulation to separate the two layers. Thus, any minimal entanglement which may be created will be removed during the conventional subsequent processing.

Turning again to FIG. 1, the hydrodynamically treated fabric is finished used conventional techniques known in the art. For instance, depending upon the desired application, the dried fabric may be dyed and/or bleached. As is also conventional in the art, griege fabric is batched for bleaching or dyeing. Where the treated fabric is 100 percent cotton or a derivative thereof, the knitted fabric is immersed in a dye bath (Step 130) and dyed with reactive type dyestuffs. After dyeing, the fabric is padded (Step 140) to remove excess dyestuff. If other fiber types are included, separate dye baths may be required. For the exemplary data shown in FIG. 4, all of the tested fabric was bleached, and not dyed.

The dyed and padded fabric is next dried (Step 150) in a conventional manner at belt speeds and temperatures well known in the art. As also described in greater detail below, the dyeing or bleaching, and drying steps further enhance the desired properties of the hydrodynamically treated fabric. Following the drying step, the tubular knitted fabric is subjected to a conventional calendering operation (Step 160), which further conditions and compacts the fabric, while improving the hand of the fabric.

Referring now to FIG. 3, the effects of the hydrodynamic treatment of the tubular knitted fabric and subsequent finishing are graphically illustrated. As shown in FIG. 3A, illustrative yarns 312 in two layers of the greige fabric show minimal signs of fiber breakage, or barbing, which tends to create hooks extending from the yarn surfaces. Further, and as shown in the Figure, gaps X, Y, which represent the overlap of the two loops in a knitted course, are present between the loops of each yarn 312 in the top A and bottom B layers of the fabric, respectively. As an example of the process of the present invention, prior to hydrodynamic treatment, the gaps X, Y, as would normally be expected, might be about ⅛ inches; however, this is exemplary of one of many possible dimensions depending upon the various knitting parameters as well as the yarn sizes, etc. The fabric has an initial weight basis of 2.15 ounces per square yard.

Figure 3A:
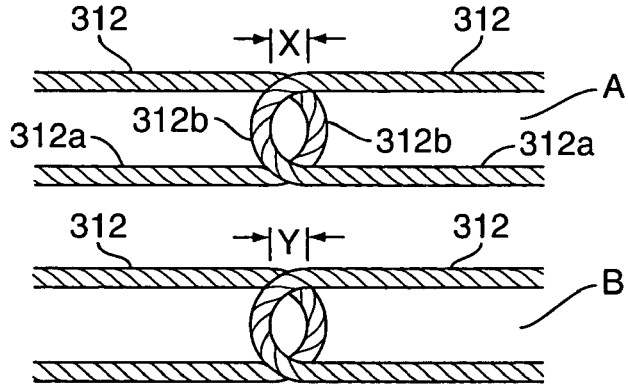
FIGS. 3A through 3D are graphical illustrations of the changes in structure of the loops of tubular knitted fabrics that are created by the hydrodynamic conditioning and finishing process of the present invention.
Figure 3B:
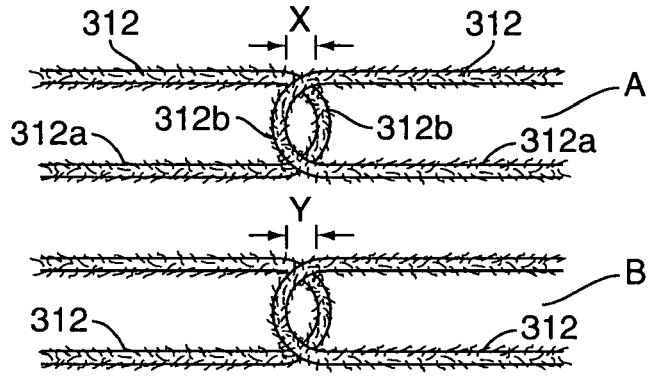

Referring to FIG. 3B, the effects of the hydrodynamic treatment are illustrated. Whereas conventional hydrodynamic treatment has the effect of permanently entangling the fibers of overlying layers, the inventors have found that at sufficiently low hydrodynamic pressures, the fibers comprising the yarns tend to fracture, creating a plurality of barbs 312*a* over their entire surface areas, yet do not interlock the discrete layers A and B in any appreciable, measurable fashion. As shown in FIG. 3B, at pressures between about 25 bar and 40 bar (absolute), the barbs 312*a* of yarns 312 tend to interlock the individual knitted loops of the fabric together. Further, following the hydrodynamic treatment process of the current invention, the gaps X, Y are reduced through both the compacting action of the hydrodynamic treatment and the interlocking of the barbs 312*a* to between approximately ⅙ inches (top layer A) and approximately 1/16 inches (bottom layer B). The creation and initial interlocking of the barbs facilitates the reduction in the size of the gaps X, Y during the subsequent processing, as described below. The weight basis of the fabric has also increased to between 4.23 and 4.51 ounces per square yard.

Figure 3C:
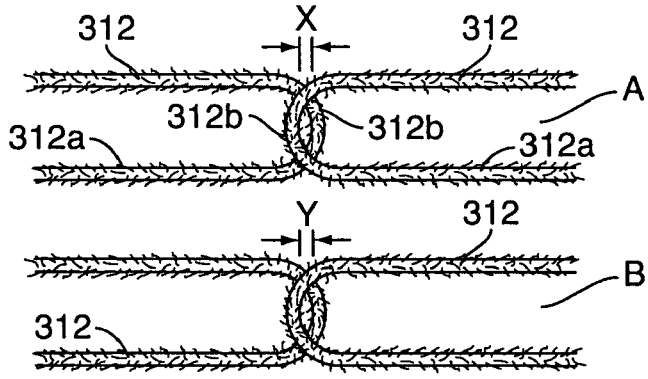

Turning to FIG. 3C, following the dyeing and bleaching step (Step 130), and padding of the dyed or bleached fabric (Step 140), the average gap X, Y for the top A and bottom B layers of the knitted fabric is further reduced to between approximately ⅛ inches and 1/16 inches, respectively. Subsequent drying of the dyed or bleached fabric (Step 150), the gap X, Y is further reduced through drying action to between approximately 1/32 inches, respectively, for the top A and bottom B layers. The weight basis of the fabric remains between 4.06 and 4.44 ounces per square yard.

Figure 3D:
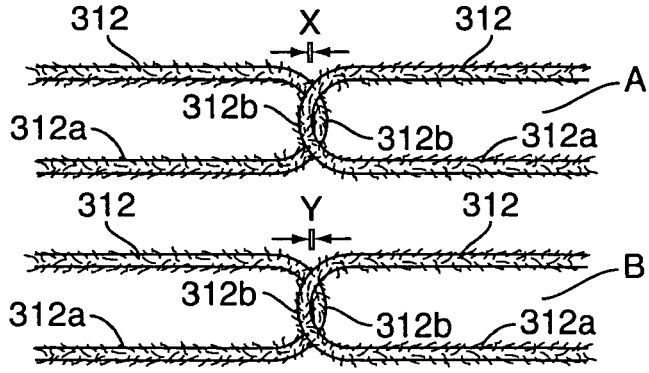

Finally, and referring to FIG. 3D, following calendaring, the gaps X, Y are further reduced to between about 0.0 inches and less than 1/32 inches for the top A and bottom B layers, respectively. In effect, then, the combined processes of the hydrodynamic treatment, dyeing/bleaching, drying, and calendaring causes the tubular knitted fabric gaps to close, unexpectedly yielding a substantially more dimensionally stable tubular knitted fabric than has been heretofore produced.

Turning lastly to FIG. 4, detailed numerical measurements of the results for various pressures and line speed combinations of the current process are shown. FIG. 4 comprises three separate data sections: Untreated Fabric (Greige), Hydrodynamically Treated Fabric, and Bleached and/or Dyed Fabric. By way of example, the Untreated Fabric comprises measured data for a 100 percent tubular knitted jersey fabric comprising, a 28/1 yarn and having an initial width (comprising two overlying layers) of 23.625 inches and a weight basis of 2.15 ounces per square yard. The weight basis is measured in accordance with Standard ASTM D-3776-96, "Standard Test Method for Mass Per Unit Area (Weight) of Fabric. As shown in the table, for one embodiment the initially formed greige fabric had a residual shrinkage after five home launderings of 15.2 percent in the length dimension and 12.3 percent in the width dimension, when laundered and measured in accordance with AATCC Test Method 135-1995, "Dimensional Changes in Automatic Home Laundering of Woven and Knit Fabrics." Dimensional changes in the length and width are expressed as a percentage of the initial dimension of the specimen. As will be appreciated by those of ordinary skill in the art, the greater the dimensional changes that result from home laundering, the less desirable and/or less predictable is the fabric, or apparel made therefrom, to the ultimate consumer. For tubular knitted fabric applications, maximum dimensional change, or shrinkage, of 5 percent or less in both the length and width directions is considered desirable.

As shown for the Hydrodynamically Treated Fabric in FIG. 4, various combinations of jet manifold pressures and line speeds were tested and measured. As will be understood, minor variations in handling of the fabric following hydrodynamic treatment, or hydrodynamic treatment followed by bleaching and/or dyeing, in combination with errors in measurements, result is minor variations in test results for similarly processed specimens. At one end of the spectrum of pressure/speed combinations, for example, a specimen was hydrodynamically treated at a pressure of 40 bar and a line speed of 120 meters per minute. The residual shrinkage was reduced by the hydrodynamic treatment to about 14 percent in the length dimension and 3.6 percent in the width dimension after five home launderings. This is approximately an 8 percent reduction in residual shrinkage in the length dimension and a 63 percent reduction in the width dimension. The weight basis of the treated fabric also increased about 97 percent to 4.23 ounces per square yard. When further subjected to bleaching/dyeing, drying, and calendaring, the residual shrinkage for the same specimen was further reduced in the width dimension to about 6.5 percent in the length dimension and increased to about 6 percent in the width dimension. The weight basis decreased slight to 4.06 ounces per square yard. The increase in the width dimension and slight decrease in the weight basis are the result of the mechanical action of the calendaring process.

At the opposite end of the pressure/speed spectrum, a specimen of the same fabric construction was treated at a pressure of 25 bar and a line speed of 30 meters per minute. The residual shrinkage was reduced by the hydrodynamic treatment to about 10.8 percent in the length dimension and 7 percent in the width dimension. This is approximately a 29 percent reduction in residual shrinkage in the length dimension and a 43 percent reduction in the width dimension. The weight basis increased to 4.25 ounces per square yard. When further subjected to bleaching/dyeing, drying, and calendaring, the residual shrinkage for the same specimen was further reduced to about 4.7 percent in the length dimension and decreased to 5.9 percent in the width dimension. The weight basis remained unchanged.

As shown in FIG. 4, at higher jet manifold pressures, higher line speeds may be used to obtain acceptable results. Conversely, at lower jet manifold pressures, lower line speeds are necessary to achieve similar results. Thus, any number of combinations of speeds of 120 meters per minute and pressures of between about 25 bar and 40 bar would provide results consistent with those described herein.

Additionally, as shown in FIG. 4, the bursting strength of the tested greige fabric is 77.5 pounds as measured in accordance with Standard ASTM D 3787-01, Standard Test Method for Bursting Strength of Textiles—Constant-Rate-of-Traverse (CRT) Ball Burst Test. After subjecting the knitted fabric to the hydrodynamic treatment described herein, the fabric had a bursting strength between about 77 and 80, with an average bursting strength of about 78. Thus, the bursting strength of the hydrodynamically treated fabric is relatively unchanged, demonstrating that the hydrodynamic treatment does not degrade or weaken the fabric.

Referring again to FIG. 4, the initial greige fabric has a measured resistance to pilling of 4/4 (front/back) after a first cycle and 3/3 after a second cycle when measured in accordance with Standard ASTM D 3512, Standard Test Method for Pilling Resistance and Other Related Surface Changes of Textile Fabrics: Random Tumble Pilling Tester. After subjecting the knitted fabric to the hydrodynamic treatment described herein, the measured resistance to pilling remains unchanged for the various combinations of pressure and line speed. Thus the hydrodynamically treated fabric is not more susceptible to pilling, and would not have a higher pill rate, as a result of the treatment, even though the hydrodynamic treatment has the effect of creating barbs, or hooks, on the surfaces of the yarns forming the fabric. Further, and as shown in FIG. 4, subsequent bleaching or dyeing of the hydrodynamically treated fabric does not decrease the resistance of the dyed or bleached fabric to pilling.

Lastly, garments (T-shirts) formed from the tubular knitted fabric were subjected to repeated laundering up to five home laundering cycles in accordance with AATCC Test Method 135. The following measured residual shrinkage values were obtained:

| | | 25 bar 30 m/min | 30 bar 30 m/min | 35 bar 100 m/min |
|---|---|---|---|---|
| 1 Wash | Length | 3.3% | 3.45% | 5% |
| | Width | 5.3% | 5.1% | 5.9% |
| 3 Washings | Length | 5.8% | 4.25% | 5.8% |
| | Width | 5.3% | 5.1% | 5.9% |
| 5 Washings | Length | 6.7% | 5.3% | 7.5% |
| | Width | 5.3% | 5.1% | 5.9% |

These results illustrate that garments formed from tubular knitted fabric that is treated and finished in accordance with the method described herein exhibit relatively low levels of residual shrinkage, a desired characteristic of finished retail apparel.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the appended claims and their equivalents. It should also be understood that terms used herein should be given their ordinary meaning to a person of ordinary skill in the art, unless specifically defined or limited in the application itself or in the ensuing prosecution with the Patent Office.

We claim:

1. A method for conditioning a tubular knitted fabric, comprising the steps of:

placing on a supported member a tubular knitted fabric formed of yarns, the yarns comprising fibers having a high cotton content, and the fabric having layers arranged in overlying layered relation, the layers having outer surfaces;

traversing the tubular knitted fabric at a preselected rate while subjecting the outer surfaces of the overlying layers to jets of fluid at pressures of about 40 bar absolute or lower; and wherein the jets of fluid fracture at least some of the fibers comprising the yarns, the fractured yarns comprising each of the overlying layers interlock within each layer, and the fibers forming the overlying layers do not interlock the overlying layers and are separable by subsequent fabric finishing or laundering.

2. The method of claim 1 wherein the preselected speed is at least about 30 meters per minute.

3. The method of claim 1 wherein the outer surfaces of the overlying layers are subjected to jets of fluid at pressures between about 25 bar absolute and about 40 bar absolute.

4. The method of claim 1 wherein fabric finishing comprises at least one of the steps of bleaching/scouring, dyeing, padding, drying, and calendaring the tubular knitted fabric.

5. The method of claim 1 wherein the jets of fluid are water.

6. The method of claim 1 wherein the interlocked yarns dimensionally stabilize each layer in length and width directions.

7. The method of claim 1 wherein the tubular knitted fabric has a first weight basis before being subjected to jets of fluid and a second weight basis after being subjected to jets of fluid, and wherein the second weight basis is greater than the first weight basis.

8. The method of claim 7 wherein the second weight basis is about twice the first weight basis.

* * * * *